United States Patent [19]

Felder

[11] Patent Number: 5,019,477

[45] Date of Patent: May 28, 1991

[54] VINYLTOLUENE AND STYRENE COPOLYMERS AS RESINS FOR LIQUID ELECTROSTATIC TONERS

[75] Inventor: Thomas C. Felder, Downingtown, Pa.

[73] Assignee: DX Imaging, Lionville, Pa.

[21] Appl. No.: 375,660

[22] Filed: Jul. 5, 1989

[51] Int. Cl.[5] ..... G03G 9/13; G03G 9/135

[52] U.S. Cl. ..... 430/115; 430/114

[58] Field of Search ..... 430/114, 115

[56] References Cited

U.S. PATENT DOCUMENTS

| | | | |
|---|---|---|---|
| 3,843,538 | 10/1974 | Vermeulen et al. | 430/114 |
| 3,850,829 | 11/1974 | Smith et al. | 430/114 |
| 3,960,737 | 6/1976 | Kawanishi | 430/114 |
| 3,976,583 | 8/1976 | Herrmann et al. | 430/114 |
| 3,993,483 | 11/1976 | Maki et al. | 430/114 |
| 3,997,488 | 12/1976 | Tsubuko et al. | 430/114 X |
| 4,032,463 | 6/1977 | Kawanishi et al. | 430/114 |
| 4,081,391 | 3/1978 | Tsubuko et al. | 430/115 |
| 4,157,974 | 6/1979 | Brechlin et al. | 430/114 |
| 4,264,699 | 4/1981 | Tsubuko et al. | 430/112 |
| 4,702,985 | 10/1987 | Larson | 430/115 |
| 4,707,429 | 11/1987 | Trout | 430/115 |
| 4,740,444 | 4/1988 | Trout | 430/137 |
| 4,760,009 | 7/1988 | Larson | 430/137 |
| 4,772,528 | 9/1988 | Larson et al. | 430/115 |
| 4,794,651 | 12/1988 | Landa et al. | 430/110 |
| 4,814,251 | 3/1989 | Igoe | 430/115 |
| 4,820,605 | 4/1989 | El-Sayed | 430/115 |

FOREIGN PATENT DOCUMENTS 58-59460 4/1983 Japan .

*Primary Examiner*—Roland Martin

[57] ABSTRACT

A liquid electrostatic developer comprising: (a) a non-polar liquid having a kauributanol value of less than 30; (b) thermoplastic resin particles comprised of a mixture of (1) a polyethylene homopolymer or a copolymer of (i) polyethylene and (ii) acrylic acid, methacrylic acid or the alkyl esters thereof, wherein (ii) comprises 0.1–20 weight percent of said copolymer and (2) a random copolymer of (iii) selected from the group consisting of vinyltoluene and styrene and (iv) selected from the group consisting of butadiene and acrylate, wherein said thermoplastic resin particles are dispersed in said non-polar liquid form; and (c) an ionic or zwitterionic charge director compound which is soluble in said non-polar liquid.

17 Claims, No Drawings

VINYLTOLUENE AND STYRENE COPOLYMERS AS RESINS FOR LIQUID ELECTROSTATIC TONERS

FIELD OF THE INVENTION

This invention relates to novel liquid electrostatic developers and a process for the production thereof.

BACKGROUND OF THE INVENTION

It is known that a latent electrostatic image can be developed with toner particles dispersed in an insulating non-polar liquid. Such dispersed materials are known as liquid toners. A latent electrostatic image may be produced by providing a photoconductive layer with a uniform electrostatic charge and subsequently discharging the electrostatic charge by exposing it to a modulated beam of radiant energy. However, other methods are known for forming latent electrostatic images. For example, one of these methods involves providing a carrier with a dielectric surface and transferring a preformed electrostatic charge to the surface.

After the latent electrostatic image has been formed, the image is developed by colored toner particles dispersed in a non-polar liquid. The image may then be transferred to a receiver sheet.

Useful liquid toners comprise a thermoplastic resin and a dispersant non-polar liquid. Generally, a suitable colorant, such as a dye or pigment, is also present. The colored toner particles are dispersed in a non-polar liquid which generally has a high volume resistivity in excess of $10^9$ ohm-centimeters, a low dielectric constant (i.e., below 3.0) and a high vapor pressure. Generally, the toner particles are less than 30u average by area size as measured using the Malvern 3600E particle sizer.

Since the formation of proper images depends on the difference of the charge between the liquid developer and the latent electrostatic image to be developed it has been found desirable to add a charge director compound and preferably other adjuvants which increase the magnitude of the charge, e.g., polyhhydroxy compounds, aminoalcohols, polybutylene succinimide compounds, aromatic hydrocarbons, metallic soaps, etc., to the liquid toner comprising the thermoplastic resin, the non-polar liquid and the colorant.

The focus of much of the work in this area has centered around the composition of the resin particles employed in the developer, since the properties of the resins are known to be directly correlated to image quality.

To improve image quality, conventional liquid developers have often been made tacky in order to increase adhesion to the receiver and thus improve transfer efficiency. Generally, tackiness can be achieved in a number of ways, e.g., through the addition of solvents which partially dissolve the resins which make up the resin particles; through the addition of low molecular weight resin fractions; and/or through the control of polymerization of the resin to produce broad molecular weight distributions. For example, U.S. Pat. No. 3,850,829 discloses negative liquid toners containing a tacky organosol means formed by dissolving a high molecular weight resin polymer in an aromatic hydrocarbon solvent and a release agent. Sticky or tacky developers produced in this manner may be disadvantageous, since they may not sufficiently redisperse upon settling. Also, due to their tacky nature, such developers are difficult to clean from photoreceptors. Additionally, cosolvents used in such developers add an undesirable odor to the developer suspension.

Also, as an attempt to improve image quality, resin modification has been heretofore proposed. For example, U.S. Pat. No. 3,993,483 discloses a liquid electrostatic developer for use in developing latent electrostatic images containing at least one member selected from two groups, including a styrene-vinyltoluene copolymer and polyethylene. The developers of this patent incorporate a coloring agent and charge director compounds, such as surfactants. U.S. Pat. No. 3,976,583 discloses electrostatic developer liquids comprising a carrier liquid in which is dispersed a solvent organic liquid, a copolymer of vinyltoluene or styrene with an acrylic acid ester, a copolymer of butadiene with styrene, a coloring agent and water. U.S. Pat. Nos. 4,264,699; 3,997,488; and 4,081,391, all to Tsuboko et al., disclose liquid developers containing resins comprising graft copolymers. These copolymers contain a polar polyester resin compound, a polyethylene wax, and a third copolymer which may be a vinyltoluene-acrylate copolymer.

U.S. Pat. No. 4,794,651 to Landa et al. discloses liquid developers comprising resin particles having fibers or tendrils. Such toners have demonstrated superior image quality in comparison to conventional liquid developers. It is believed that image quality is improved by such toners, since the resin particles are more resistant to breakup during transfer due to the intermingling of the fibers when the particles are concentrated on the photoreceptor.

Liquid toners comprising resin particles having fibers or tendrils were further disclosed and improved upon in U.S. Pat. Nos. 4,760,009; 4,707,429; 4,772,528; and 4,740,444. Specifically, these references disclose improved processes for the production of such resin particles, as well as the dispersion of certain adjuvants in the resin particles.

However, even in light of such modifications, liquid developers heretofore proposed provided a sharply reduced image quality with varying transfer conditions.

To be effective, liquid electrostatic developers must: (1) be attracted to and adhered to a photoreceptor which bears an electrostatic image pattern; and (2) transfer from the photoreceptor to a receiver (generally paper) under the influence of an applied electric field. The transfer from the photoreceptor to a receiver is affected by many external factors, such as temperature, humidity, receiver dielectric constant and surface texture, photoreceptor charge relaxation rate and surface properties, developer conductivity, etc. It is difficult and expensive to precisely control all of these factors and accordingly, it is desirable for developers to transfer uniformly under a wide range of applied fields and conditions. This property can be referred to as transfer latitude. Specifically, transfer latitude refers to the range of applied voltage under which a toner will transfer to a receiver without degradation of image quality. Generally, liquid electrostatic developers having a high mobility and an increased concentrate shear viscosity demonstrate a wide transfer latitude. Conventional developers generally demonstrate a restrictively narrow transfer latitude (i.e., provide adequate images only under a narrow range of applied voltages) which places unnecessarily rigorous demands on the tolerances of the transfer system.

Also, toners with wide transfer latitudes tend to give good transferred images from many different types of photoreceptors without the necessity of being specifically reformulated to suit the individual requirements of each type of photoreceptor. As many types of photoreceptors are known and used in the art, developers with wide transfer latitudes would clearly be advantageous.

Because of their narrow transfer latitudes, conventional developers demonstrate difficulties in providing multiple layer images. For example, one method of providing multiple layer images is to transfer one layer at a time to a receiver sheet without fusing the toner between transfers. A requirement of such a process is that a layer of toner particles must remain on the receiver sheet during all subsequent transfers. However, with conventional developers, the layers frequently become separated from the receiver during subsequent transfer and adhere instead to the photoreceptor, causing a loss of image quality. This phenomenon can be referred to as "back-transfer." As a general rule, "back-transfer" increases as tackiness of the developer increases, and decreases as mobility increases and shear viscosity is optimized.

Also, the surfaces of photoreceptors can be contaminated by trace amounts of impurities in the developer. This contamination can decrease image quality by reducing the developer's ability to adhere to the photoreceptor. Generally, it has been found that developers with a low mobility are more susceptible to the effects of drum contamination.

Therefore, it is an object of the present invention to provide a liquid electrostatic developer for developing latent electrostatic images which improves image quality, even as transfer conditions vary. An additional object of the present invention is to provide a liquid electrostatic developer which provides good multiple layer images without being degraded by backtransfer. A further object of the present invention is to provide toners which avoid the detrimental effects caused by photoreceptor surface contamination. An even further object of the present invention is to provide a liquid developer which transfers well without necessarily being tacky.

SUMMARY OF THE INVENTION

The present invention is directed to a liquid electrostatic developer comprising:

(a) a non-polar liquid having a kauri-butanol value of less than 30;

(b) thermoplastic resin particles comprising: (1) a polyethylene homopolymer or a copolymer of (i) polyethylene and (ii) acrylic acid, methacrylic acid or the alkyl esters thereof, wherein (ii) comprises 0.1–20 weight percent of the copolymer and (2) a random copolymer of (iii) selected from the group consisting of vinyltoluene and styrene, and (iv) selected from the group consisting of butadiene and acrylate, wherein the thermoplastic resin particles are dispersed in the non-polar liquid; and (c) an ionic or zwitterionic charge director compound.

A method for producing a liquid electrostatic developer according to the present invention comprises mixing the polymers in the non-polar liquid, heating the mixture until a uniform dispersion is formed, adding a further amount of the non-polar liquid, subsequently cooling the dispersion to solidify the resin, and adding an ionic or zwitterionic charge director compound.

It has been found that the toners employed in the present liquid electrostatic developers demonstrate higher mobility, higher charge and an increased concentrate viscosity and thereby, a widened transfer latitude. Accordingly, the developers of the present invention provide images of improved quality.

DETAILED DESCRIPTION OF THE INVENTION

The present inventor has found that the liquid electrostatic developers of the present invention demonstrate a high mobility, a high charge to mass ratio, and an increased shear viscosity, as compared to conventional developers. These factors, which relate to a wide transfer latitude, allow the present developer to provide images of consistently good quality over a wide range of transfer conditions. Accordingly, these factors generally correspond to improved image quality.

Although not limited to any one theory, it is the belief of the present inventor that increased shear viscosity makes the toner resistant to disruptive shear forces generated during transfer from the photoreceptor to the receiver. In the present developer, at working strength, the viscosity is low to facilitate handling of the developer. However, upon being concentrated on a photoreceptor, the shear viscosity of the developer becomes high, allowing the developer to resist shear forces. Accordingly, in contrast to many conventional developers, the present liquid electrostatic developers achieve the resistance to shear force without requiring tackiness.

Through the use of the present resins, it is possible to obtain an increased shear viscosity without changing the processing conditions necessary for making the developer. By eliminating the necessity for changes in processing conditions, manufacture of the developers is simplified.

The present liquid electrostatic developer is a dispersion comprising thermoplastic resin particles, ionic or zwitterionic charge director compounds, and optionally colorants and other adjuvants, in a non-polar liquid having a kauri-butanol value of less than 30. The toner solids of the present invention are substantially insoluble in the carrier liquid, in contrast to some conventional developers wherein solubilizing action is often desired in order to increase the tackiness of the developer.

The thermoplastic resin particles employed in the liquid electrostatic developer of the present invention comprise a mixture of (1) a polyethylene homopolymer or a copolymer of (i) polyethylene and (ii) acrylic acid, methacrylic acid or their alkyl esters, wherein (ii) comprises 0.1–20 weight percent of the copolymer; and (2) a random copolymer of (iii) selected from the group consisting of vinyltoluene and styrene and (iv) selected from the group consisting of butadiene and acrylate. Preferably, the thermoplastic resin particles comprise a mixture of (1) a polyethylene-methacrylic acid copolymer and (2) a random copolymer of vinyltoluene and acrylate.

The amounts of (iii) and (iv) in the random copolymer is not critical. However, in general, appropriate random copolymers are those wherein the aromatic portion (i.e., the styrene and vinyltoluene portion) accounts for about 45 to 98 percent by weight of the copolymer. Preferably, the aromatic portion accounts for 75 to 93 percent and more preferably 80 to 90 percent by weight of the copolymer. The remainder of the copolymer is the aliphatic portion (i.e., the butadiene and acrylate portion).

Preferably, the random copolymer comprises a mixture of (iii) vinyltoluene or styrene and (iv) butadiene or acrylate. The random copolymer of (iii) vinyltoluene or styrene and (iv) butadiene or acrylate used in the present developer liquid has a molecular weight of about 71,000 to 194,000. Preferably, the molecular weight of the random copolymer should be about 78,000 to about 152,000.

As the thermoplastic random copolymer of (iii) vinyltoluene or styrene and (iv) butadiene or acrylate, there may be used, e.g., a member of the Pliotone ® or Pliolite ® resin series, both manufactured by the Goodyear Tire & Rubber Company, Akron, Ohio.

Pliotone ® resins are emulsion copolymers pairing styrene or vinyltoluene with butadiene or various acrylate monomers. The aromatic portion (i.e., the styrene or vinyltoluene portion) accounts for the major fraction of the resin, i.e., as high as 90 percent. The aliphatic portion (i.e., butadiene or acrylate) makes up the remainder of the resin. Pliotone ® resins are provided in four sets of monomer pairs as follows: styrene/butadiene; styrene/acrylate; vinyltoluene/butadiene; and vinyltoluene/acrylate, designated 1000 to 4000, respectively.

Certain Pliolite ® resins correspond to members of the Pliotone ® series. For example, Pliolite ®, VTAC is a vinyltoluene/acrylate resin which is equivalent to Pliotone ® 4000. For such resins, the specifications will be the same as that of the corresponding Pliotone ® resin.

The Pliotone ® resins have a melt index value ranging from 1 to 25 (grams/10 min. at 150° C. using 2160 gram load). The Pliotone ® 1000 series resins have a molecular weight of 71,000–163,000; the 2000 series resins have a molecular weight of 73,000–175,000; the 3000 series resins have a molecular weight of 78,000–152,000; and the 4000 series resins have a molecular weight of 83,000–194,000.

The thermoplastic resin particles of the present developers further comprise a polyethylene homopolymer or a copolymer of (i) polyethylene and (ii) acrylic acid, methacrylic acid or alkyl esters thereof.

The polyethylene comprises about 80 to 99.9 percent by weight of the copolymer. The acrylic acid, methacrylic acid or their alkyl esters may be present in an amount of about 0.1 to 20 percent by weight of the copolymer.

Appropriate homopolymers and copolymers of (i) and (ii), have an acid number of from 1 to 90, and preferably 54–66. (The acid number is the milligrams of potassium hydroxide required to neutralize 1 gram of polymer.) Also, appropriate polymers of this type have a melt index (mg/10 min) of 1 to 500, preferably 100 to 500, as determined by ASTM D1238-79 Procedure. The polymers should have a softening point of 105° to 148° C., and preferably 105° to 110° C., as measured by the ASTM E 28-67 method.

As the copolymers of (i) polyethylene and (ii) acrylic acid or acrylic acid alkyl ester there may be used, e.g., the Primacor ® resins by Dow Chemical Co., Midland, Mich.

As the copolymers of (i) polyethylene and (ii) methacrylic acid or methacrylic acid alkyl esters, there may be used, e.g., the Nucrel ® and Elvax ® resins by E. I. Dupont de Nemours and Company, Wilmington, Del.

Appropriate alkyl esters comprise 1 to 5, and preferably 1 to 2, carbon atoms. There is no specific limitation on the alkyl groups which may be used in the methacrylic acid alkyl esters of the present invention.

The thermoplastic resin particles comprise about 50–99 percent, and preferably about 70–80 percent by weight of the total solid content (i.e., resin, colorant and adjuvants) of the liquid developers of the present invention.

The thermoplastic resin particles of the present developers, should have an average by area particle size from about 0.5 to 30u, and preferably about 1.0 to about 15u, as measured by the Malvern 3600E particle sizer. The resin particles of the present liquid electrostatic developer may be comprised of a plurality of fibers integrally extending therefrom, although the formation of such fibers extending from the toner particles is preferred. The term "fibers" as used herein means pigmented toner particles formed with fibers, tendrils, tentacles, threadlets, fibrils, ligaments, hairs, bristles, etc.

The thermoplastic resin particles are comprised of from about 5 to about 50 percent, and preferably about 20 to about 30 percent by weight, of the random copolymers. Accordingly, the present liquid developers contain about 4–40 percent, and preferably about 16–24 percent by weight of the random copolymers.

The non-polar liquid having a kauri-butanol value of less than 30 employed as a dispersant in the present invention is preferably a branched-chain aliphatic hydrocarbon. More particularly, a non-polar liquid of the Isopar ® series (manufactured by the Exxon Corporation) may be used in the present developers. These hydrocarbon liquids are narrow cuts of isoparaffinic hydrocarbon fractions with extremely high levels of purity. For example, the boiling range of Isopar ® G is between 157° C. and 176° C.; Isopar ® H is between 176° C. and 191° C.; Isopar ® K is between 177° C. and 197° C.; Isopar ® L is between 188° C. and 206° C.; Isopar ® M is between 207° C. and 254° C.; and Isopar ® V is between 254.4° C. and 329.4° C. Isopar ® L has a mid-boiling point of approximately 194° C. Isopar ® M has an auto ignition temperature of 338° C. Isopar ® G has a flash point of 40° C. as determined by the tag closed cup method; Isopar ® H has a flash point of 53° C. as determined by the ASTM D-56 method; Isopar ® L has a flash point of 61° C. as determined by the ASTM D-56 method and Isopar ® M has a flash point of 80° C. as determined by the ASTM D-56 method.

Due to stringent manufacturing specifications, impurities such as sulfur, acids, carboxyl groups, and chlorides are limited to a few parts per million. These liquids are substantially odorless, i.e., they possess only a very mild paraffinic odor. They also have an excellent odor stability.

All of the non-polar liquids for use in the present invention should have an electrical volume resistivity in excess of $10^9$ ohms/centimeters and a dielectric constant below 3.0. Moreover, the vapor pressure at 25° C. should be less than 10 torr.

While the Isopar ® series are the preferred non-polar liquids for use as dispersants in the present liquid electrostatic developers, the essential characteristic of all suitable non-polar liquids is the kauri-butanol value. Specifically, the non-polar liquids employed in the present liquid electrostatic developers have a kauri-butanol value of about 25 to about 30, and preferably about 27 to 28, as determined by the ASTM D-1136 method.

The kauri-butanol value can be defined as a measure of the aromatic content (and hence, the solvent power) of a hydrocarbon liquid. The kauri-butanol value is a measure of the volume of solvent required to produce turbidity in a standard solution containing kauri gum dissolved in butanol. Kauri gum is readily soluble in butanol but insoluble in hydrocarbons. Accordingly, low kauri-butanol values represent non-polar aliphatic solvents with high dielectric constants and low volume resistivities.

The amount of the non-polar liquid employed in the developer of the present invention is about 90–99.9, and preferably 95–99, percent by weight of the total toner dispersion. The total solids content of the present developer is 0.1 to 10 percent by weight, preferably 0.3 to 3 percent and more preferably, 0.5 to 2.0 percent by weight.

Appropriate ionic or zwitterionic charge director compounds employed in the present invention include those which are soluble in the non-polar liquid. For example, negative charge directors, such as lecithin, oil-soluble petroleum sulfonate, e.g., Basic Calcium Petronate®, Basic Barium Petronate® (both manufactured by the Sonneborn Division of Witco Chemical Corporation, New York, N.Y.) and alkyl succinimide may be used. Alternatively, positive charge directors such as cobalt and iron naphthanates, may be used. Charge directors which may provide either negative or positive toners dependent upon compositional factors of the toner may also be used. Examples of such charge directors are anionic phosphated mono- and di-glycerides, such as Emphos® D70-30C, and Emphos® F27-85 (manufactured by Witco Chemical Corporation, New York, N.Y.)

The ionic or zwitterionic charge director compounds may be used in amounts of from about 0.25 to about 1,500 parts per thousand, and preferably about 30–80 parts per thousand, of the total amount of solids contained in the developer (i.e., based on total toner solids). That is, these compounds may comprise about 0.25 percent to about 150 percent, and preferably about 3 to about 8 percent by weight of the total solid content of the present developers.

The liquid electrostatic developer of the present invention may optionally contain a colorant dispersed in the resin particles. Colorants, such as pigments or dyes and combinations thereof, are preferably present to render the latent image visible.

The colorant may be present in the developer in an amount of from about 0.1 to about 60 percent, and preferably from about 1 to about 30 percent by weight based on the total weight of solids contained in the developer. The amount of colorant used may vary depending on the use of the developer.

Examples of pigments which may be used in the present developers are set forth below.

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |

-continued

| Pigment Brand Name | Manufacturer | Color |
|---|---|---|
| Hansa Yellow X | Hoechst | Yellow 75 |
| Novoperm ® Yellow HR | Hoechst | Yellow 83 |
| L75-2337 Yellow | Sun Chem. | Yellow 83 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophthal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue TBD 7010 | BASF | Blue:3 |
| Heliogen ® Blue K 7090 | BASF | Blue 15:3 |
| Heliogen ® Blue L 7101F | BASF | Blue 15:4 |
| Heliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet | Ciba-Geigy | Violet 19 |
| Monastral ® Red | Ciba-Geigy | Violet 19 |
| Quindo ® Red 6700 | Mobay | Violet 19 |
| Quindo ® Red6713 | Mobay | Violet 19 |
| Indofast ® Violet | Mobay | Violet 19 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont. | White 6 |
| Mogul L 77266 | Cabot | Black, CI |
| Uhlich ® BK 8200 | Paul Uhlich | Black |

In order to increase the toner charge and accordingly, increase the mobility and transfer latitude of the toners, charge adjuvant agents may also be dispersed in the resin particles. For example, negative charge adjuvants, such as metallic soaps (e.g., aluminum or magnesium stearate or octoate) and fine particle size oxides (such as the oxides of silica, alumina, titania, etc.) are added in the case of producing a developer containing negatively chargeable resin particles, and positive charge adjuvants, such as para-toluene sulfonic acid, and polyphosphoric acid, are added when producing a developer containing positively chargeable resin particles. That is, negative charge adjuvants increase the negative charge of a toner particle, while the positive charge adjuvants increase the positive charge of the toner particles. The charge adjuvants are added to the present developer in an amount of from about 1 to about 1000 mg/g, and preferably from about 5 to about 60 mg/g of the total weight of solids contained in the developer.

Examples of the above-noted metallic soaps are aluminum stearate; aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthanates; calcium, cobalt, manganese, lead and zinc resinates; etc. The metallic soap may be dispersed in the thermoplastic resin as described in Assignee's U.S. Pat. No. 4,707,429 and U.S. Pat. No. 4,740,444.

Other negative charge adjuvants which may be used in the present developer are the polyhydroxy compounds, i.e., those which contain at least two hydroxy groups and polybutylene/succinimide compounds. These adjuvants may also be used in amounts of from about 1 to 1,000 mg/g, and preferably from about 5 to 60mg/g, of the total amount of solids contained in the developer.

Examples of these compounds are as follows:

Polyhydroxy compounds:

ethylene glycol; 2,4,7,9-tetramethyl-5-decyn-4,7-diol; poly(propylene glycol); pentaethylene glycol; tripropylene glycol; triethylene glycol; glycerol; pentaerythritol; glycerol-tri-12 hydroxystearate; ethylene glycol monohydroxy-stearate, propylene glycerol monohydroxy-stearate; etc., as described in Assignee's U.S. Pat. No. 4,734,352.

Polybutylene/succinimide compounds:

OLOA ®-1200 by Chevron Corp., analysis information appears in U.S. Pat. No. 3,900,412, to Kosel column 20, lines 5 to 13; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, with the remainder being oil. Such compounds are disclosed in Assignee's U.S. Pat. No. 4,702,984.

Another optional component of the present liquid electrostatic developers are aminoalcohol compounds which stabilize the conductivity of the developer solutions. Conductivity is a factor which determines the amount of toner required to neutralize a given photoreceptor charge. Consequently, image density is, in part, dependant upon conductivity. Examples of the aminoalcohol compounds are as follows: triisopropanolamine; triethanolamine; ethanolamine, 3-amino-1-propanol; o-aminophenol; 5-amino-1-pentanol: tetra(2-hydroxyethyl)ethylenediamine; etc., as disclosed in Assignee's U.S. Pat. No. 4,702,985.

The present liquid electrostatic developer may be produced by mixing, in a non-polar liquid having a kauri-butanol value of less than 30, (1) a polyethylene homopolymer or a copolymer of (i) polyethylene and (ii) acrylic acid, methacrylic acid or their alkyl esters, wherein (ii) comprises 0.1–20 weight percent of the copolymer and (2) a random copolymer of (iii) selected from the group consisting of vinyltoluene and styrene and (iv) selected from the group consisting of butadiene and acrylate, so that the resulting mixture contains about 15–30 percent by weight of solids; heating the mixture to a temperature from about 70° to about 130° C. until a uniform dispersion is formed; adding an additional amount of non-polar liquid sufficient to decrease the total solids concentration of the developer to about 10–20 percent by weight; cooling the dispersion to about 10° to about 50° C.; adding to the dispersion an ionic or zwitterionic charge director compound which is soluble in said non-polar liquid; and diluting the dispersion to working strength.

In the initial mixture, the copolymers are added separately to an appropriate vessel (e.g., an attritor) with enough non-polar liquid to provide a dispersion of about 15–30 percent solids. This mixture is subjected to elevated temperatures during the initial mixing procedure in order to plasticize and soften the resin. The mixture must be sufficiently heated to provide a uniform dispersion of all solid materials (i.e., colorant, adjuvant and resin). However, the temperature at which this step is undertaken must not be so high as to degrade the non-polar liquid or decompose the resin or colorant if present. Accordingly, the mixture is heated to a temperature of from about 70° to about 130° C., and preferably to about 75° to about 110° C. The mixture is ground at this temperature for about 15 minutes to 5 hours and preferably about 45 to about 90 minutes.

After grinding at the above-noted temperatures, an additional amount of non-polar liquid is added to the dispersion. The amount of non-polar liquid to be added at this point should be an amount sufficient to decrease the total solids concentration of the dispersion to about 10–20 percent by weight.

The dispersion is then cooled to about 10° to about 50° C., and preferably to about 15° to about 30° C., while mixing is continued, until the resin admixture solidifies or hardens. Upon cooling, the resin admixture precipitates out of the dispersant liquid. The dispersion is cold ground for about 1 to 36 hours, and preferably 2–6 hours.

The cooling step may be achieved in the same vessel in which the mixture was heated and mixed, while maintaining grinding with particulate media in the presence of the additional non-polar liquid in order to prevent the formation of a gel or solid mass. Alternatively, the cooling step may be accomplished with stirring to form a viscous dispersion and then grinding by means of particulate media in the presence of additional liquid. On the other hand, cooling may be accomplished without stirring or grinding in order to form a gel or solid mass, followed by the shredding of the gel or solid mass and grinding by means of particulate media. Cooling is accomplished by means known to those in the art and is not limited to cooling by circulating cold water or a cooling material through an external cooling jacket adjacent to the dispersing apparatus.

Additional non-polar liquid may be added at this point to further dilute the dispersion if recirculation in the dispersing apparatus is necessary to provide a more uniform dispersion.

After cooling, the dispersion of toner particles is separated from the dispersion medium by any appropriate means known to those skilled in the art. For example, any of gravity feed methods, vacuum filtration methods, etc., may be used.

An ionic or zwitterionic charge director compound is then added to impart a positive or negative charge to the developer, as desired. The ionic or zwitterionic charge director compound must be soluble in the non-polar liquid. The addition may occur at any time during the process, but preferably is performed at the end of the procedure, i.e., after separation. If a diluting non-polar liquid is also added to reduce the concentration of toner particles in the dispersion as discussed below, the charge director compound may be added prior to, concurrently with, or subsequently thereto. As indicated above, the ionic or zwitterionic charge director compound may be added in an amounts of from 0.25 mg/g to 1,500 mg/g, and preferably about 30–80 mg/g of the total amount of solids present in the developer.

In order to facilitate handling of the developer, the concentration of toner particles in the dispersion may be reduced by the further addition of non-polar liquid. The dilution is normally conducted to reduce the concentration of toner particles to between 0.1 to 10 percent by weight, and preferably 0.3 to 3.5 percent by weight and more preferably 0.5 to 3.0 percent by weight of the dispersant non-polar liquid.

Although the dilution step may be carried out after the charge is imparted to the developer, the sequence of these steps is not critical.

If a colorant and/or any adjuvants are to be used in the present liquid electrostatic developer, these ingredients should be mixed directly with the resin and non-polar liquid (i.e., in step (a)), so that the colorant and/or adjuvants may be dispersed directly and uniformly into the resin particles.

The present developer liquid may be prepared in a suitable mixing or blending vessel, e.g., an attritor, a heated ball mill, or a heated vibratory mill.

The presence of irregularly moving particulate media in the vessel is preferred in order to prepare the dispersion, although other stirring means may be used. Useful particulate media include, e.g., spherical or cylindrical stainless steel, carbon steel, alumina ceramic, zirconium, silica and sillimanite material. Carbon steel particulate media is particularly useful when colorants other than black are used. A typical diameter range for the particulate media is in the range of from about 0.04 to 0.5 inch.

The present invention will now be illustrated by reference to the following specific, non-limiting examples. All amounts indicated are parts by weight unless otherwise specified.

EXAMPLE I

Electrostatic liquid developers were prepared as set forth below.

Comparative Examples 1–4 and Examples 1–4 were prepared as follows. The thermoplastic resin particles, a colorant, aluminum stearate and a non-polar liquid were added to a 1S attritor (by Union Process). The temperature of the mixture was brought to 95° to 105° C. by running steam through the jacket. The mixture was ground at a rotor speed of 125 RpM for about one hour. 512 grams of Isopar® L was then added to the mixture, and the temperature of the mixture was then reduced to about 15° to 25° C. by circulating cold water through the jacket. The rotor speed was increased to 250 RPM and the mixture was further ground for 2.0 hours at the reduced temperature. 1000 grams of Isopar® L was then added to the attritor to dilute the toner concentrate to about 1.5 percent solids. 19.0 grams of 10 percent Witco Basic Barium Petronate® in Isopar® L was added to about 2500 grams of 1.5 percent toner, bringing the toner conductivity to 20 to 25 pmho/cm.

COMPARATIVE EXAMPLE 1

236.2 g Nucrel® 599
46.1 g Quindo® Red R6713
13.8 g Quindo® Red R6700
3.0 g Witco 133 Aluminum Stearate
1000.0 g Isopar® L

EXAMPLE 1

177.2 g Nucrel® 599
59.1 g Pliolite® VTAC
46.1 g Quindo® Red R6713
13.8 g Quindo® Red R6700
3.0 g Witco 133 Aluminum Stearate
1000.0 g Isopar® L

COMPARATIVE EXAMPLE 2

236.2 g Nucrel® 599
59.8 g L 74-1357 Yellow
3.0 g Witco 133 Aluminum Stearate
1000.0 g Isopar® L

EXAMPLE 2

177.2 g Nucrel® 599
59.1 g Pliolite® VTAC
59.8 g L 74-1357 Yellow
3.0 g Witco 133 Aluminum Stearate
1000.0 g Isopar® L

COMPARATIVE EXAMPLE 3

236.2 g Nucrel® 599
59.8 g Heliogen® Blue L7560 cyan pigment
3.0 g Witco 133 Aluminum Stearate
1000.0 g Isopar® L

EXAMPLE 3

177.2 g Nucrel® 599
59.1 g Pliolite® VTAC
59.8 g Heliogen® Blue L7560 cyan pigment
3.0 g Witco 133 Aluminum Stearate
1000.0 g Isopar® L

COMPARATIVE EXAMPLE 4

236.2 g Nucrel® 599
59.9 g Sterling® NS Carbon Black
1000.0 g Isopar® L

EXAMPLE 4

177.2 g Nucrel® 599
59.1 g Pliolite® VTAC
59.9 g Sterling® NS Carbon Black
1000.0 g Isopar® L The Pliotone® resins series comprise the following monomer pairs:

1000 Styrene/Butadiene 3000 Vinyltoluene/Butadiene

2000 Styrene/Acrylate 4000 Vinyltoluene/Acryate

The last two digits of the series number indicates the melt index of the particular resin. Pliolite® VTAC is a resin comprising vinyltoluene and acrylate, and is functionally equivalent to Pliotone® resins of the 4000 series.

Comparative Examples 1–4 were then compared with Examples 1–4, with the results set forth in Table I below. The examples were tested for toner mobility with an ESA (Electrokinetic Sonic Analysis) device by Matec, Hopkinton, Mass.

The amount of charge on the toner particles is represented by Q/M (i.e., charge to mass ratio). Charge to mass ratio is determined by placing a known mass of toner between conductive parallel plates and subjecting the toner to a DC field for a specified period. The toner will develop out on one of the plates and current will flow through the circuit. The current is integrated, and from the data collected, charge to mass ratio is calculated. Generally, Q/M values around 100uC/g signify an acceptable toner.

Images were obtained on a testbed consisting of a selenium alloy photoreceptor drum which was charged to a surface potential of +700 V with a scorotron, and then discharged to 90 V imagewise with a laser imager. The latent electrostatic image was developed from a flat plate toning electrode set to a potential of +100 V and gapped 0.035 inches from the photoreceptor surface. The developed image was metered with a 0.5 inch diameter steel roller gapped 0.005 inches from the photoreceptor, rotated at 5 inches per second in the opposite direction as the drum rotation, and biased to +125V. The developed images were transferred to Solitaire® paper (by Plainwell Paper Co., Plainwell, Mich.) at 2 inches per second through a transfer zone defined at the lead edge by a conductive rubber roller biased to −3000 volts and at the trail edge by a corotron wire. The corotron wire was set to +6.0 kV and the housing was grounded. The paper was prewetted with Isopar® L prior to transfer and brought into contact with the photoreceptor drum by the conductive rubber roller. The transferred image was then fused for 1 minute in a drying oven set to 105° C. The image consisted of a test pattern of solid stripes and dots ranging in gradations of 5 from 0 to 100% area coverage with test patterns.

Images were evaluated on the basis of crispness of leading and trailing edges on solid patches; density uniformity within the solid patch; side-to-side and top-to-bottom density uniformity over the entire print; microscopic quality of test characters (i.e., text, stars, squares, etc.); and microscopic uniformity of dots.

As discussed below, "goal quality" means satisfactory to excellent results in each of the following characteristics—edge sharpness, solids uniformity, text, and dot quality. "Near goal quality" is constituted by adequate edge sharpness, good uniformity, adequate text, but a somewhat broken dot structure. "Marginal quality" is constituted by broken edge sharpness, fair uniformity, irregular text and a poor, broken dot structure. Quality becomes unacceptable when edges are smeared, density nonuniformity is obvious to the eye, and text and dots are substantially broken up.

As can be seen from Table I below, the developers employing the present resin mixture provided higher mobilities and higher charge to mass ratio values than developers employing resin particles comprising only polyethylene-methacrylic acid copolymers. Higher mobilities and charge toner values relate directly to improved image quality as is consistent with the results in Table I.

The units used in Table I are: Mobility (ESA): $10^{10}$ $m^2/V$-sec; Q/M: uC/g,

TABLE I

| Example No. | Mobility (ESA) | Q/M of Toner Particle | Image Quality |
|---|---|---|---|
| Comparative Example 1 | −5.66 | 56.5 | Marginal |
| Example 1 | −15.7 | 116.2 | Goal |
| Comparative Example 2 | −9.4 | 60.5 | Near Goal |
| Example 2 | −14.6 | 142.3 | Goal |
| Comparative Example 3 | −6.75 | 46.6 | Marginal |
| Example 3 | −14.6 | 120.7 | Goal |
| Comparative Example 4 | −7.29 | 39.9 | Marginal |
| Example 4 | −13.3 | 127.0 | Goal |

EXAMPLE II

Examples 5–10 were prepared by adding the resin materials, the colorants, adjuvants and the non-polar liquid described below to a 1S attritor (by Union Process). The temperature was brought to 95° to 105° C. by running steam through the attritor jacket and the mixture was ground at 188 RPM for about one hour. 500 grams of Isopar® L was then added to the mixture, and the attritor temperature was reduced to about 15° to 25° C. by circulating cold water through the attritor jacket. Mixing was continued while maintaining the rotor speed at 188 RPM for about 2 hours. 1200 grams of Isopar® L was then added to the attritor to dilute the toner concentrate to 1.5 percent solids. 19.0 grams of 10% Witco Basic Barium Petronate in Isopar® L was added to 2500 grams of 1.5 percent toner, bringing the toner conductivity to 20 to 25 pmho/cm.

EXAMPLE 5

177.2 g Nucrel® 599
59.3 g Pliotone® 4003
60.0 g Heliogen® Blue NBD-7010 cyan pigment
3.0 g Witco 133 Aluminum Stearate
1000.0 g Isopar® L

EXAMPLE 6

177.8 g Nucrel® 599
59.3 g Pliotone® 3002
60.0 g Heliogen® Blue NBD-7010 cyan pigment
3.0 g Witco 133 Aluminum Stearate
1000.0 g Isopar® L

EXAMPLE 7

177.8 g Nucrel® 599
59.3 g Pliotone® 2003
60.0 g Heliogen® Blue NBD-7010 cyan pigment
3.0 g Witco 133 Aluminum Stearate
1000.0 g Isopar® L

EXAMPLE 8

177.8 g Nucrel® 599
59.3 g Pliotone® 2015
60.0 g Heliogen® Blue NBD-7010 cyan pigment
3.0 g Witco 133 Aluminum Stearate
1000.0 g Isopar® L

EXAMPLE 9

177.8 g Nucrel® 599
59.3 g Pliotone® 1010
60.0 g Heliogen® Blue NBD-7010 cyan pigment
3.0 g Witco 133 Aluminum Stearate
1000.0 g Isopar® L

EXAMPLE 10

177.8 g Nucrel® 599
59.3 g Pliotone® 4010
60.0 g Heliogen® Blue NBD-7010 cyan pigment
3.0 g Witco 133 Aluminum Stearate
1000.0 g Isopar® L The mobility, charge to mass ratio (Q/m) and image quality of Examples 5–10 were determined in the same manner described in Example I. The results are set forth in Table II below.

TABLE II

| ID No. | Mobility (ESA) | Q/M | Image Quality |
|---|---|---|---|
| Example 5 | 11.50 | 96.9 | Goal |
| Example 6 | 12.35 | 75.9 | Goal |
| Example 7 | 10.31 | 86.4 | Near Goal |
| Example 8 | 9.95 | 75.4 | Near Goal |
| Example 9 | 9.07 | 37.9 | Marginal |
| Example 10 | 6.60 | 57.4 | Marginal |
| Comparative Example 3 | 6.75 | 46.6 | Unacceptable |

Units used in the Table II: Mobility: $10^{10}$ $m^2/V$-sec; Q/M: uC/g

As can be seen in Table II, the toners of the present invention comprising the random copolymers of (iii), vinyltoluene or styrene and (iv) butadiene or acrylate, consistently provide higher mobility, charge to mass values and improved image quality.

Examples 5 and 6 gave goal quality images, while Examples 7 and 8 gave near goal quality images showing only an imperfect dot structure. Examples 9 and 10 provided marginal quality images, as the solids smeared slightly, and they demonstrated some leading edge cracking and side-to-side non-uniformity. Comparative Example 3 provided images of unacceptable quality.

Each of Examples 5–9 demonstrated a higher mobility than the Comparative Example, while each of Examples 5–8 and 10 demonstrated a higher charge to mass ratio than the Comparative Example. Again, these results are consistent with the image quality findings, i.e., higher mobility and charge correspond to a widened transfer latitude and an improved image quality.

EXAMPLE III

Liquid developers containing resins comprising 0%, 5%, 15%, 25%, 50%, 75% and 100% of the random copolymers of (i) vinyltoluene or styrene and (ii) butadiene or acrylate were tested to determine the effects of concentration of the present random copolymers on mobility.

Examples 11 through 17 were prepared by grinding the mixtures described below at 100° C. for 1 hour. 512 g of Isopar® L was then added to reduce the total concentration of solids in the mixture to 10–15 percent by weight. The mixture was then ground at about 20° C. for 2.0 hours, diluted to working strength and charged with Basic Barium Petronate®.

EXAMPLE 11

236.2 g Nucrel® 599 (100%)
59.8 g Heliogen® Blue NBD-7010 cyan pigment
3.0 g Witco 133 Aluminum Stearate
1000.0 g Isopar® L

EXAMPLE 12

224.2 g Nucrel® 599 (95%)
11.8 g Pliotone® 3002 (5%)
59.8 g Heliogen® Blue NBD-7010 cyan pigment
3.0 g Witco 133 Aluminum Stearate
1000.0 g Isopar® L

EXAMPLE 13

208.0 g Nucrel® 599 (85%)
35.4 g Pliotone® 3002 (15%)
59.8 g Heliogen® Blue NBD-7010 cyan pigment
3.0 g Witco 133 Aluminum Stearate
1000.0 g Isopar® L

EXAMPLE 14

177.2 g Nucrel® 599 (75%)
59.1 g Pliotone® 3002 (25%)
59.8 g Heliogen® Blue NBD-7010 cyan pigment
3.0 g Witco 133 Aluminum Stearate
1000.0 g Isopar® L

EXAMPLE 15

118.1 g Nucrel® 599 (50%)
118.1 g Pliotone® 3002 (50%)
59.8 g Heliogen® Blue NBD-7010 cyan pigment
3.0 g Witco 133 Aluminum Stearate
1000.0 g Isopar® L

EXAMPLE 16

59.1 g Nucrel® 599 (25%)
177.2 g Pliotone® 3002 (75%)
59.8 g Heliogen® Blue NBD-7010 cyan pigment
3.0 g Witco 133 Aluminum Stearate
1000.0 g Isopar® L

EXAMPLE 17

236.2 g Pliotone® 3002 (100%)
59.8 g Heliogen® Blue NBD-7010 cyan pigment
3.0 g Witco 133 Aluminum Stearate
1000.0 g Isopar® L The mobility of Examples 11–17 was tested with an ESA device by Matec, in the same manner as in Examples I and II.

As can be seen in the graph set forth below, Example 14 which contained 25% of the random copolymers of (iii) vinyltoluene or styrene and (iv) butadiene or acrylate demonstrated the highest mobility. In contrast, Example 11 which contained 0% of the random copolymer demonstrated the lowest mobility of all samples tested. Examples 16 and 17 did not produce usable toner, as the resin formed a ball after being discharged from the attritor.

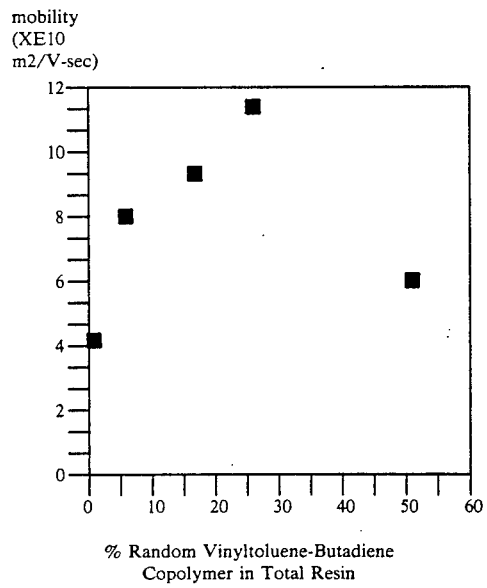

EXAMPLE IV

An effect of the incorporation of the random copolymers of vinyltoluene or styrene and butadiene or acrylate in the present liquid electrostatic developers is to raise the viscosity of the developer achieved at a given grind time, as well as to raise the toner mobility. That is, the incorporation of these polymers allow one to change the viscosity of the dispersion without the necessity of changing the processing conditions.

A pair of toners were prepared as follows:

COMPARATIVE EXAMPLE 5

276.5 g Nucrel° 599
53.9 g Quindo® Red 6713
16.1 g Quindo® Red 6700
3.5 g Witco 133 Aluminum Stearate
1172.0 g Isopar® L

EXAMPLE 18

207.4 g Nucrel ® 599
69.1 g Pliotone ® 3002
53.9 g Quindo ® Red 6713
16.1 g Quindo ® Red 6700
3.5 g Witco 133 Aluminum Stearate
1172.0 g Isopar ® L The examples were prepared by hot grinding in a 1S attritor (by Union Process) at 100° C.±3° C. for one hour at a speed of 125 RPM. An additional 1395 g of Isopar ® L was then added to the mixture. The mixture was then cold ground at 25° C.±3° C. for six hours. The samples were removed from the attritor at grind times of 2, 4 and 6 hours. The samples were then diluted to 10% solids with Isopar ® L and the viscosity of each was measured on a Brookfield digital viscometer. The samples were then diluted to 3% solids with Isopar ® L and charged with 70 parts per thousand of toner solids with Witco Basic Barium Petronate ®. The mobility of the samples was then measured with a Matec ESA machine. The viscosity at 10 percent solids and the mobility of the sample is set in Table III below, at 2, 4 and 6 hour grind times.

TABLE III

| Developer | Grind Time (Hours) | 10% Viscosity (cP) | Mobility ($10^{10}$ $m^2$/V-sec) |
|---|---|---|---|
| Comparative Example 5 | 22 | 448 | 7.7 |
| Example 18 | 2 | 6144 | 11.5 |
| Comparative Example 5 | 4 | 5296 | 9.8 |
| Example 18 | 4 | 8032 | 12.9 |
| Comparative Example 5 | 6 | 5600 | 10.9 |
| Example 18 | 6 | 9328 | 13.4 |

As is apparent, Example 18 demonstrated a higher viscosity as well as a higher mobility for each of the 2, 4, and 6 hour grind times as compared to the developer containing polyethylenemethacrylic acid copolymers alone.

EXAMPLE V

Example V demonstrates the use of a copolymer of (i) polyethylene and (ii) acrylic acid to achieve the superior results of the present invention.

A pair of cyan toners was prepared as follows:

COMPARATIVE EXAMPLE 6

| | |
|---|---|
| Poly(ethylene-co-acrylic acid) #6517 (by Polysciences, Warrington, PA) | 237.0 grams |
| Heliogen ® Blue NBD 7010 | 60.0 grams |
| Aluminum Stearate (Witco 22) | 3.0 grams |
| Isopar ® L | 1004 grams |

EXAMPLE 19

| | |
|---|---|
| Poly(ethylene-co-acrylic acid) #6517 (by Polysciences, Warrington, PA) | 177.8 grams |
| Pliotone ® 3002 | 59.3 grams |
| Heliogen ® Blue NBD 7010 | 60.0 grams |
| Aluminum Stearate (Witco 22) | 3.0 grams |
| Isopar ® L | 1004 grams |

Comparative Example 6 and Example 19 were prepared by hot grinding in a 1S attritor (by Union Process) at 100°±3° C. for 1 hour at a rotor speed of 125 RPM. An additional 571 grams of Isopar ® L was then added to the mixture. The mixture was then cold ground at 25°±3° C. for 3 hours.

The toners were drained from the attritor and diluted to 10.0% solids. The viscosity of the toner was then measured on a Brookfield digital viscometer. The toners were then diluted to 3.0% solids with Isopar ® L and charged with 70 parts per thousand Witco Basic Barium Petronate (based on total solids). The mobility of the 3.0% toner was measured on a Matec ESA machine. Mobility and viscosity of each of Example 19 and Comparative Example 6 is shown in Table IV below.

TABLE IV

| | Viscosity at 10% Solids (cP) | Mobility ($10^{10}$ $m^2$/V-sec) |
|---|---|---|
| Comparative Example 6 | 1328 | 2.99 |
| Example 19 | 3072 | 4.97 |

As can be seen in Table IV, mobility and viscosity are increased for the toner of the present invention in comparison to conventional toner.

EXAMPLE VI

Example VI demonstrates the improved transfer latitude of the developers of the present invention in comparison to conventional liquid developers.

COMPARATIVE EXAMPLE 7

| | |
|---|---|
| Nucrel ® 599 | 20.9 |
| Witco 22 Aluminum Stearate | 0.6 |
| Quindo ® Red 6713 | 6.1 |
| Quindo ® Red 6700 | 1.1 |
| Isopar ® L | 71.4 |

The materials were added to a Union Process 200S attritor and ground at 80° C. for 1 hour. Enough Isopar ® L was then added to dilute the mixture to approximately 20 percent solids, and the temperature was reduced to 25° C. The mixture was then ground for an additional 2 hours. It was then determined that, in order to facilitate recirculation in the attritor, the mixture had to be further diluted. According, enough Isopar ® L was added to reduce the concentrate to about 15 percent solids and recirculation was begun. Recirculation exchanges material from the bottom to the top of the attritor to produce a more uniform grinding condition. The mixture was then ground for 6 hours at 25° C. The toner concentrate was discharged, diluted to 1.5% solids with additional Isopar ® L, and 50 parts per thousand of toner solids of Witco Basic Barium Petronate ® was added, bringing solution conductivity to 20 pmho/cm.

EXAMPLE 20

| | |
|---|---|
| Nucrel ® 599 | 13.5 |
| Pliotone ® 3002 | 4.5 |
| Witco 22 Aluminum Stearate | 0.2 |
| Quindo ® Red 6713 | 3.4 |
| Quindo ® Red 6700 | 1.1 |
| Isopar ® L | 77.1 |

These materials were added to a Union Process 200S attritor, and ground at 98° to 102° C. for 1 hour. Enough Isopar® L was then added to dilute the mixture to about 20 percent solids. The temperature was then reduced to 25° to 30° C. and the mixture was ground for an additional 2 hours. Next, enough Isopar L was added to dilute the mixture to about 15 percent solids to facilitate recirculation. Recirculation was begun and the mixture was ground for 8 hours at 25° to 30° C. The toner concentrate was then discharged, and the mixture was diluted to 1.5% solids, and 50 parts per thousand of Witco Basic Barium Petronate® was added, bringing solution conductivity to 22 pmho/cm.

Comparative Example 7 and Example 20 were evaluated on the testbed described in Example II. Transfer conditions, specifically the voltage of the roller bias and corotron, were varied as indicated below with the following results being achieved.

| Toner | Roller Bias (kV) | Corotron Current (uA) | Image Quality |
|---|---|---|---|
| Comparative Example 7 | −2 | 10 | Unacceptable |
| Example 20 | −2 | 10 | Near Goal |
| Comparative Example 7 | −2 | 15 | Unacceptable |
| Example 20 | −2 | 15 | Near Goal |
| Comparative Example 7 | −2 | 20 | Unacceptable |
| Example 20 | −2 | 20 | Near Goal |
| Comparative Example 7 | −3.5 | 10 | Marginal |
| Example 20 | −3.5 | 10 | Near Goal |
| Comparative Example 7 | −3.5 | 15 | Marginal |
| Example 20 | −3.5 | 15 | Near Goal |
| Comparative Example 7 | −3.5 | 20 | Marginal |
| Example 20 | −3.5 | 20 | Near Goal |
| Comparative Example 7 | −5 | 10 | Unacceptable |
| Example 20 | −5 | 10 | Unacceptable |
| Comparative Example 7 | −5 | 15 | Near Goal |
| Example 20 | −5 | 20 | Goal |
| Comparative Example 7 | −5 | 20 | Marginal |
| Example 20 | −5 | 150 | Goal |

Under all conditions, the image quality obtained using Example 20 equals or exceeds the image quality obtained using Comparative Example 7. These results demonstrate the improved transfer latitude of the toners of the present invention.

EXAMPLE VII

Example VII demonstrates that the present resins provide toners which resist backtransfer.

COMPARATIVE EXAMPLE 8

| | |
|---|---|
| Nucrel® 599 | 20.9 |
| Aluminum Stearate (Witco Lot No. EU-5695) | 0.6 |
| Quindo® Red 6713 | 6.1 |
| Quindo® Red 6700 | 1.1 |
| Isopar® L | 71.4 |

These materials were added to a Union Process 200S attritor and were ground at 80°±2° C. for 1 hour. Sufficient Isopar® L was added to dilute the mixture to about 20 percent solids and the temperature was reduced to 25°±3° C. The mixture was then ground for an additional 2 hours. Next, additional Isopar® L was added (enough to bring the mixture to about 15 percent solids) and recirculation was begun. The mixture was then ground for 6 hours at the same temperature. The toner concentrate was discharged, diluted to 1.5% solids, and 50 parts per thousand of toner solids of Witco Basic Barium Petronate® was added. Before testing, toner conductivity was adjusted to 14 pmho/cm by the dropwise addition of 10% Witco Basic Barium Petronate® in Isopar® L.

EXAMPLE 21

| | |
|---|---|
| Nucrel® 599 | 13.5 |
| Pliotone® 3002 | 4.5 |
| Aluminum Stearate (Witco 22) | 0.2 |
| Quindo® Red 6713 | 3.4 |
| Quindo® Red 6700 | 1.1 |
| Isopar L | 77.1 |

These materials were added to a Union Process 200S attritor and were ground at 100°±3° C. for 1 hour. Sufficient Isopar® L was then added to bring the mixture to about 20 percent solids and the temperature was reduced to 25°±3° C. The mixture was then ground for an additional 2 hours. Next, additional Isopar® L was added (enough to dilute the mixture to about 15 percent solids) and recirculation was begun. The mixture was then ground for 6 hours at the same temperature. The toner concentrate was discharged, diluted to 1.5% solids, and 50 parts per thousand of Witco Basic Barium Petronate® was added. Before testing, toner conductivity was adjusted to 14 pmho/cm by the dropwise addition of 10% Witco Basic Barium Petronate® in Isopar L.

Comparative Example 8 and Example 21 were evaluated for backtransfer on a testbed using photopolymer master material (as disclosed in Riesenfeld et al., U.S. Pat. No. 4,732,831) as the photoreceptor. The photopolymer master was exposed imagewise with an ultraviolet source through a silver halide film bearing an image pattern. This rendered the exposed areas resistive, while the unexposed areas remained conductive. The photopolymer was then mounted on a steel drum, and the conductive backing of the film was grounded to the drum.

The drum rotated at 2.2 inches/second. The photopolymer master was charged to a surface voltage of +220 volts with a scorotron, and the charge decayed to background levels in the conductive areas, thus forming a latent electrostatic image. This latent electrostatic image was developed 3.6 seconds after charging using a pair of grounded roller toning electrodes gapped 0.010 inches from the photopolymer surface and rotated at 3.9 inches/second in the direction of the drum rotation, through which the liquid developer was delivered. The developed image was metered with a 1.5 inch diameter steel roller gapped 0.004 inches from the photopolymer, rotated at 4.7 inches/second in the opposite direction of the drum rotation and biased to +50 volts. The developed image was then transferred to Productolith paper (by Consolidated Papers, Inc., Chicago, IL) at 2.2 inches/second through a transfer zone defined at the lead edge by a biased conductive rubber roller and at the trail edge by a corotron. The roller bias was set at −3500 volts, the corotron wire current was set at 150 uamps, and the corotron housing was grounded. The paper receiver was tacked to the surface of the photopolymer by the biased conductive rubber roller, and the motion of the drum pulled the paper through the transfer zone. The final transferred image was fused for 1 minute in a drying oven at 177° C.

To evaluate the backtransfer of a developer, up to four images were transferred successively to the receiver without fusing between transfers. The images were positionally offset from one another to sufficiently distinguish each. After each transfer, the photopolymer master was inspected for the presence of backtransferred toner. Previously transferred images on the receiver were examined for integrity. Toners which were susceptible to backtransfer detached from the paper receiver during transfer and adhered to the photopolymer master, thus degrading the quality of the transferred image.

When the control toner (Comparative Example 8) was evaluated as described above, backtransfer was observed on the second, third and fourth transfers. On the other hand, Example 21, comprising the resins of the present invention, demonstrated no backtransfer. To further test the resistance of the present toners to backtransfer, a fifth image was transferred atop the other four. Again, no backtransfer was observed. This demonstrates the improved backtransfer resistance of toners containing the polymer mixtures of the present invention.

The present invention may be embodied in other specific forms without departing from the spirit or essential attributes thereof and, accordingly, reference should be made to the appended claims, rather than to the foregoing specification as indicating the scope of the invention.

I claim:

1. A liquid electrostatic developer consisting essentially of:

(a) a non-polar liquid having a kauri-butanol value of less than 30;

(b) thermoplastic resin particles comprising a mixture of (1) a polyethylene homopolymer or a copolymer of (i) ethylene and (ii) acrylic acid, methacrylic acid or the alkyl esters thereof, wherein (ii) comprises about 0.1–20 weight percent of said copolymer and (2) a random copolymer of (iii) a monomer selected from the group consisting of vinyltoluene and styrene and (iv) a monomer selected from the group consisting of butadiene and acrylate, wherein said thermoplastic resin particles are dispersed in said non-polar liquid; and (c) an ionic or zwitterionic charge director compound which is soluble in said non-polar liquid.

2. A liquid electrostatic developer as in claim 1, wherein said random copolymer is a copolymer of (iii) vinyltoluene and (iv) acrylate.

3. A liquid electrostatic developer as in claim 1, wherein said thermoplastic resin particles comprise a mixture of (1) a polyethylenemethacrylic acid copolymer and (2) a random copolymer of vinyltoluene and acrylate.

4. A liquid electrostatic developer as in claim 1, wherein said thermoplastic resin particles comprise from about 5 to about 50 percent by weight of said random copolymer.

5. A liquid electrostatic developer as in claim 1, wherein said thermoplastic resin particles comprise about 20–30 percent by weight of said random copolymer.

6. A liquid electrostatic developer as in claim 1, wherein the alkyl group of said ester comprises 1–5 carbons.

7. A liquid electrostatic developer as in claim 1, further comprising a colorant.

8. A liquid electrostatic developer as in claim 7, wherein said colorant is selected from the group consisting of a pigment and a dye.

9. A liquid electrostatic developer as in claim 7, wherein said colorant is contained in an amount of from about 0.1 to about 60% by weight of the total weight of solids in the developer.

10. A liquid electrostatic developer as in claim 1, further comprising a negative charge adjuvant.

11. A liquid electrostatic developer as in claim 10, wherein said negative charge adjuvant is a metallic soap.

12. A liquid electrostatic developer as in claim 11, wherein said metallic soap is aluminum stearate.

13. A liquid electrostatic developer as in claim 1, wherein said ionic or zwitterionic charge director compound is selected from the group consisting of oil soluble petroleum sulfonate, alkyl succinimide and lecithin.

14. A liquid electrostatic developer as in claim 1, wherein said thermoplastic resin particles comprise from about 50 to 99 percent by weight of the total weight of solids in the developer.

15. A liquid electrostatic developer as in claim 1, wherein said ionic or zwitterionic charge director compound comprises from about 0.25 to about 1,500 mg/g of solids in the developer.

16. A liquid electrostatic developer comprising:

(a) a non-polar liquid having a kauri-butanol value of less than 30;

(b) thermoplastic resin particles comprising a mixture of (1) a polyethylene-methacrylic acid copolymer, wherein the methacrylic acid comprises about 0.1–20 weight percent of said copolymer and (2) a random copolymer of vinyltoluene and acrylate, wherein said thermoplastic resin particles are dispersed in said non-polar liquid; and (c) an ionic or zwitterionic charge director compound which is soluble in said non-polar liquid.

17. A liquid electrostatic developer comprising:

(a) a non-polar liquid having a kauri-butanol value of less than 30;

(b) thermoplastic resin particles comprising a mixture of (1) a polyethylene homopolymer or a copolymer of (i) ethylene and (ii) acrylic acid, methacrylic acid or the alkyl esters thereof, wherein (ii) comprises about 0.1–20 weight percent of said copolymer and (2) a random copolymer of vinyltoluene and acrylate wherein said thermoplastic resin particles are dispersed in said non-polar liquid; and (c) an ionic or zwitterionic charge director compound which is soluble in said non-polar liquid.

* * * * *